US007025372B2

(12) United States Patent
Godde et al.

(10) Patent No.: US 7,025,372 B2
(45) Date of Patent: Apr. 11, 2006

(54) SUPPORT DEVICE FOR A BINDING ELEMENT AND BOARD FOR GLIDING OVER SNOW THUS EQUIPPED

(75) Inventors: Jean-Christophe Godde, Chimilin (FR); Frédéric Eudier, Charnecles (FR)

(73) Assignee: Skis Rossignol S.A., Voiron (FR)

( * ) Notice: Subject to any disclaimer, the term of this patent is extended or adjusted under 35 U.S.C. 154(b) by 100 days.

(21) Appl. No.: 10/367,516

(22) Filed: Feb. 13, 2003

(65) Prior Publication Data

US 2003/0184052 A1 Oct. 2, 2003

(30) Foreign Application Priority Data

Mar. 27, 2002 (FR) ..... 02 03825

(51) Int. Cl.
*A63C 9/00* (2006.01)

(52) U.S. Cl. ..... 280/607; 280/636; 280/611

(58) Field of Classification Search ..... 280/611, 280/613, 623, 636, 601, 607, 609, 617, 618, 280/620, 11.14, 11.15
See application file for complete search history.

(56) References Cited

U.S. PATENT DOCUMENTS

| | | | | |
|---|---|---|---|---|
| 3,992,031 | A * | 11/1976 | Korger | 280/618 |
| 4,002,354 | A * | 1/1977 | Ramer | 280/614 |
| 4,951,961 | A | 8/1990 | Boussemart et al. | |
| 5,040,822 | A * | 8/1991 | Gallet et al. | 280/636 |
| 5,078,419 | A | 1/1992 | Wittmann et al. | |
| 5,088,757 | A * | 2/1992 | Hauglin | 280/615 |
| 5,118,128 | A * | 6/1992 | Piegay et al. | 280/633 |
| 5,564,728 | A * | 10/1996 | Renaud-Goud | 280/636 |
| 5,664,797 | A * | 9/1997 | Haughlin | 280/615 |
| 6,105,992 | A * | 8/2000 | Schaller et al. | 280/613 |
| 6,217,055 | B1 * | 4/2001 | Silva | 280/607 |
| 6,227,558 | B1 * | 5/2001 | Arduin et al. | 280/611 |
| 6,290,251 | B1 | 9/2001 | Chatillon et al. | |
| 6,637,767 | B1 * | 10/2003 | Chevalier et al. | 280/607 |
| 2001/0011808 | A1 | 8/2001 | Chevalier et al. | |

FOREIGN PATENT DOCUMENTS

| | | |
|---|---|---|
| EP | 0 378 599 | 4/1993 |
| FR | 2 666 022 | 2/1992 |
| FR | 2 741 816 | 6/1997 |
| FR | 2 755 868 | 9/2001 |
| FR | 2 287 184 | 1/2003 |

* cited by examiner

*Primary Examiner*—Christopher P. Ellis
*Assistant Examiner*—Brian Swenson
(74) *Attorney, Agent, or Firm*—Burr & Brown

(57) ABSTRACT

A support device for a binding element securing a user's boot to a board for gliding over snow has a zone for mounting on the board for gliding over snow and a zone of contact with the lower face of the sole of the boot. The support device is divided into two longitudinal parts at least in the region of the zone of contact with the lower face of the sole of the boot.

11 Claims, 3 Drawing Sheets

SUPPORT DEVICE FOR A BINDING ELEMENT AND BOARD FOR GLIDING OVER SNOW THUS EQUIPPED

This application claims the benefit of French Application 02 03825, filed Mar. 27, 2002, the entirety of which is incorporated herein by reference.

The present invention relates to a support device for a binding element. The present invention also relates to a binding element equipped with such a support device. Lastly, it relates to a board for gliding over snow equipped with such a binding element.

SUMMARY OF THE INVENTION

The object of the invention is to propose a board for gliding over snow with a support device for a binding element that is both lightweight and, by virtue of a choice of shape, further allows separation of the left and right bearing forces with a view to transmitting the forces applied by the user on the board and the forces generated more directly in the region of the left edge or of the right edge. The support device also gives the binding element a new esthetic appearance, which may make it possible to leave the protective and decorative layer of the board for gliding visible.

A support device for a binding element securing a user's boot to a board for gliding over snow has a zone for mounting on the board for gliding over snow and a zone of contact with the lower face of the sole of the boot.

According to a first aspect of the invention, the support device is divided into two longitudinal parts at least in the region of the zone of contact with the lower face of the sole of the boot.

A binding element of a board for gliding over snow may comprise such a support device. In other words, with two separate, left and right longitudinal parts, the bearing forces exerted at the front by the skier on one or other of the two longitudinal parts will be transmitted directly to the edge associated with it that is located just below, which may make it possible to increase the performance levels of the board for gliding over snow.

According to a second aspect of the invention, a binding element of a board for gliding over snow for securing a user's boot to the board for gliding over snow comprising a support device having a zone for mounting on the board for gliding over snow and a zone of contact with the lower face of the sole of the boot is noteworthy in that the support device is divided into two longitudinal parts at least in the region of the zone of contact with the lower face of the sole of the boot.

In certain cases, when the two longitudinal parts of the support device are clearly separated from one another, a space may be provided between the two longitudinal parts. This space may be left empty. This space may also be filled by one or more materials with low flexural stiffness. This material or these materials may therefore be not flush with the upper surface of the support device with a view to preventing the sole of the boot from catching them when the boot is released from the binding element.

This space may also, furthermore, be filled by a convex zone of the board for gliding over snow. This convex zone may project from the upper surface of the protective and decorative upper layer of the board for gliding over snow. This convex zone must therefore be not flush with the upper surface of the support device with a view to preventing the sole of the boot catching it when the boot is released from the binding element.

The two longitudinal parts of the support device may favorably each comprise a region that is raised relative to the upper surface of the support device.

To enhance the release properties of the binding in the event of a fall, the contact zone or the raised region of each of the two longitudinal parts of the support device may comprise a coating in a material with a low coefficient of friction on which the lower face of the sole of the boot will rest.

In a first form of use, the binding element may be mounted on the board for gliding over snow directly on the upper surface. In a second form of use, the binding element may also be mounted on the board for gliding over snow on a raising platform positioned on the upper surface of the board for gliding over snow.

In a particularly advantageous case, in order for the bearing forces exerted by the skier on one or other of the two longitudinal parts of the support device to be transmitted directly to the edge, the raising platform may be divided into two longitudinal parts that are each directly positioned on the upper surface of the board for gliding over snow. The two longitudinal parts of the raising platform may correspond to the two longitudinal parts of the support device. In a particular example, the two longitudinal parts of the raising platform are connected together by at least one bridge.

According to a third aspect of the invention, a board for gliding over snow is equipped with a binding element as described above.

BRIEF DESCRIPTION OF THE DRAWINGS

The invention will be properly understood and its various advantages and different characteristics will become more apparent from the following description of the non-limiting illustrative embodiment, with reference to the appended diagrammatic drawings in which.

DETAILED DESCRIPTION OF THE INVENTION

Figure 1:
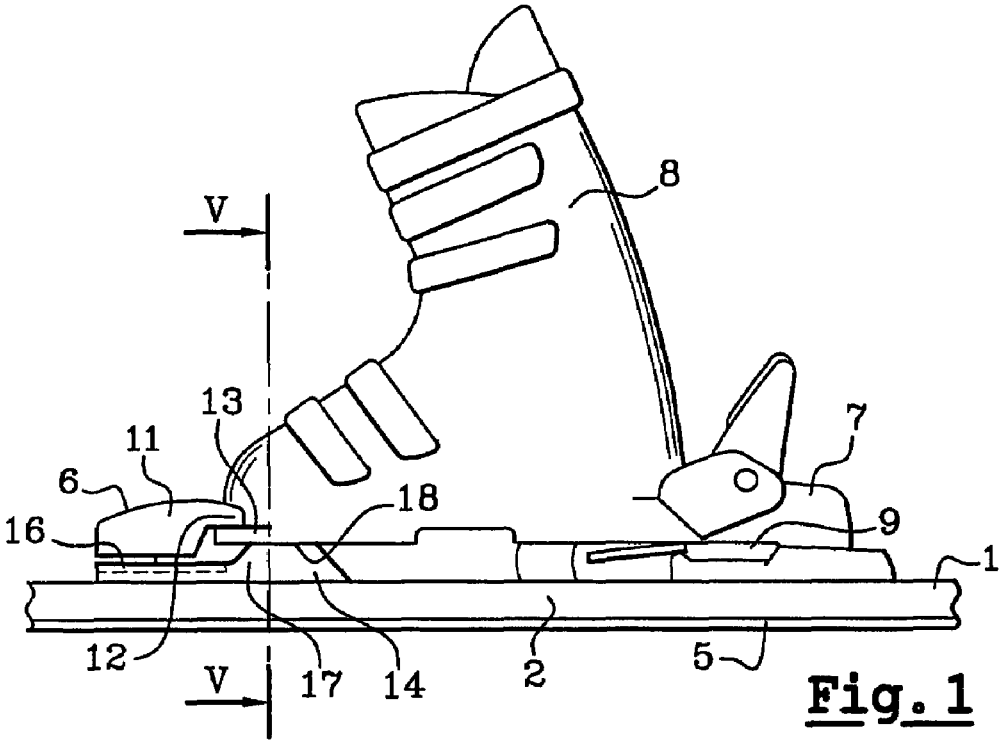
FIG. 1 shows a side view of the underfoot zone of a ski on which the bindings and a boot are mounted.
Figure 2:
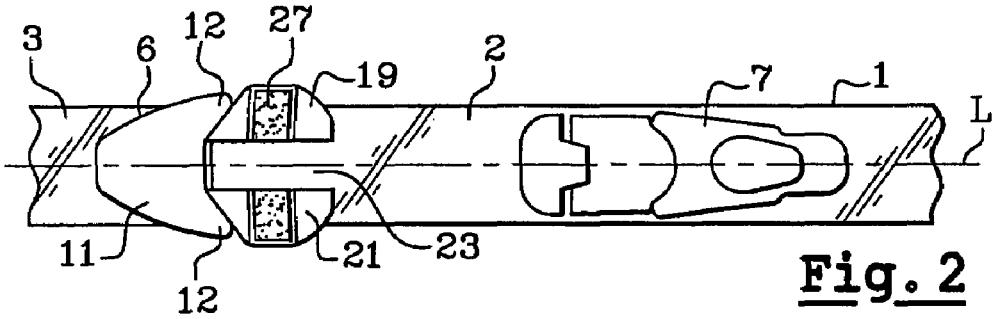
FIG. 2 shows a top view of the underfoot zone.
Figure 3:
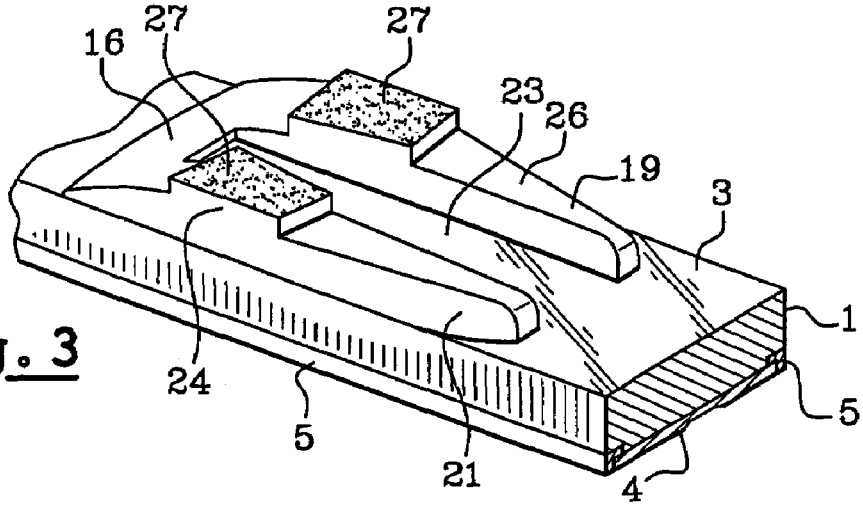
FIG. 3 shows a perspective view of the support device of the front stop.
Figure 4:
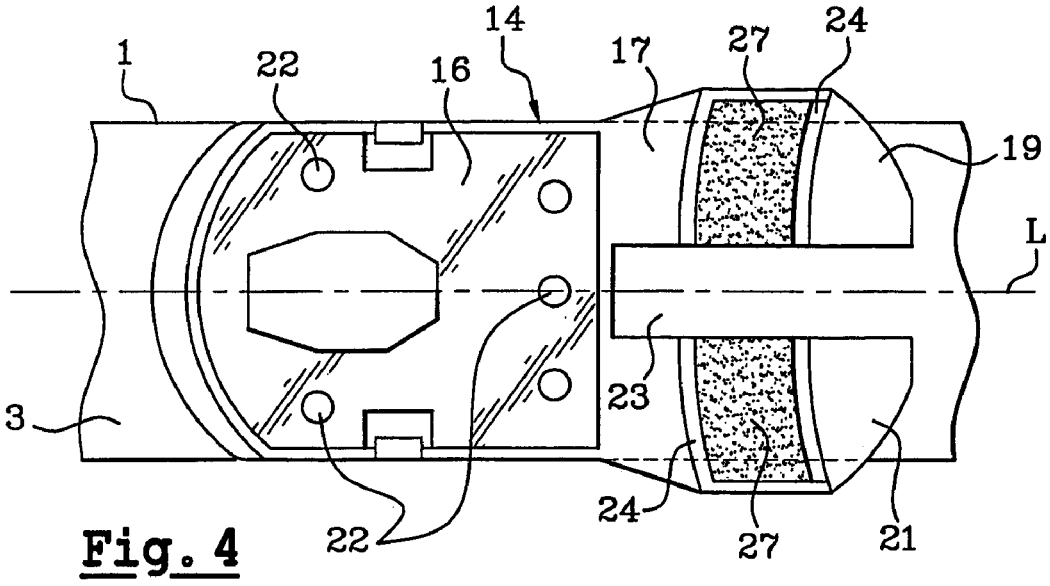
FIG. 4 shows a top view of the support device of the front stop.

A board for gliding over snow of conventional type (see FIG. 1), such as a downhill ski (1), comprises a front zone that includes a tip, a central zone known as the underfoot zone (2), a rear zone, an upper surface (3) formed by a protective and decorative upper layer, a gliding sole (4) and two side edges (5).

The binding elements, i.e. the front stop (6) and the heelpiece (7), are screwed onto the upper surface (3) of the ski (1). The front stop (6) and the heelpiece (7) firmly hold the user's boot (8). The heelpiece (7) allows fitting and release, as desired, of the user's boot (8) and includes a ski-braking device (9). The front stop (6) also allows safety release of the boot (8) in the event of the user falling.

The front stop (6) comprises a holding body (11), two side wings (12) wedging the front of the sole (13) of the boot (8), and a support device (14). The support device (14) has a mounting zone (16) and a zone (17) of contact with the lower face (18) of the sole (13) of the boot (8).

According to the invention, the support device (14) is divided into two along the central longitudinal axis (L) of the ski (1), and therefore comprises two rigid longitudinal parts (19 and 21). The possibility of having two distinct longitudinal parts (19 and 21) will mean that the forward bearing forces exerted by the skier on one or other of the two longitudinal parts (19 or 21) of the support device (14) will be transmitted directly to the edge (5) associated with it and located just below when, initiating a turn, the skier rocks his ski (1) onto that edge (5).

Figure 5:
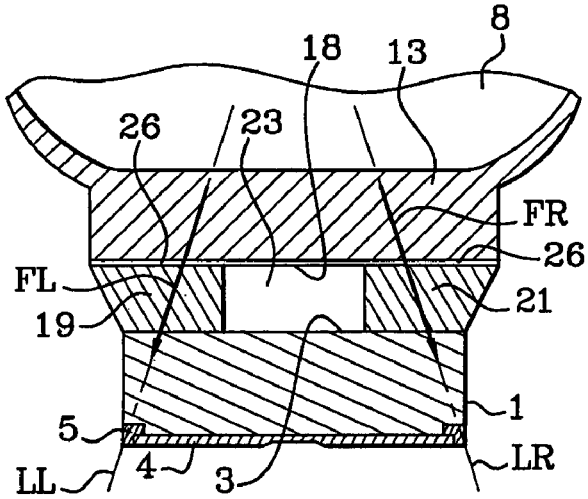
FIG. 5 shows a view in transverse section of the ski along the plane V—V of FIG. 1.
Figure 6:
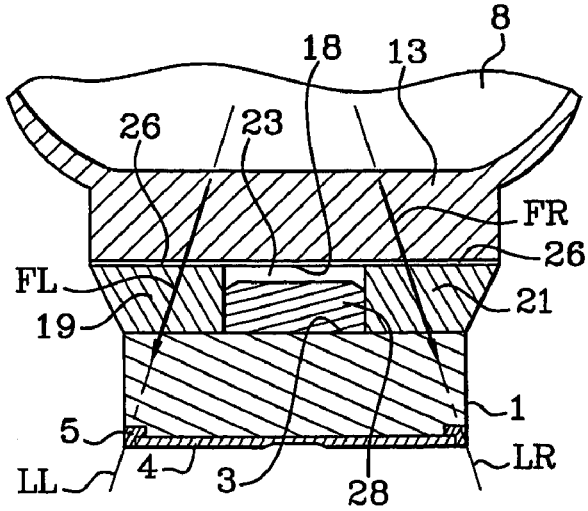
FIG. 6 shows a view in transverse section of the ski with a support device according to a further embodiment.

This is more particularly shown in FIG. 5, in which the skier, bearing forward on the left edge (5), generates the force (FL) with its force transmission line (LL) (in broken line) meeting the left edge (5). The skier, bearing forward on the right edge (5), generates the force (FR) with its force transmission line (LR) (in broken line) meeting the right edge (5).

Thus, owing to the mechanical separation of the two longitudinal parts (19 and 21), which are thus uncoupled in functional terms, the bearing forces and the forces generated on one (19) of the longitudinal parts of the support device (14) will not be transmitted substantially to the other (21) of the longitudinal parts of the support device (14) of the front stop (6). Therefore, and for greater efficiency, the maximum force applied by the skier to the ski may be transmitted to the edge in contact with the snow.

In FIGS. 2–8, the two longitudinal parts (19 and 21) are clearly separated from one another, with a distance between them. This chosen separation means that the support device (14) and thus the front stop (6) gain in lightness owing to the absence of material and to the loss of weight at the center. To ensure it is held on the ski (1), the support device (14) is screwed directly onto the upper surface (3) of the ski (1). The screws pass through through-holes (22) made through the mounting zone (16) of the support device (14). Other means of securing may be provided.

In the majority of cases, the two longitudinal parts (19 and 21) are separated from one another by a space (23). When this space (23) is left empty, the upper surface (3) of the protective and decorative upper layer is visible, which creates interesting esthetic effects. The space (23) may also be filled by one or more materials (28) (see FIG. 6), in the form of an added element, which is transparent or may have a color, and preferably a material with low flexural stiffness.

Use will be made of a material or a plurality of materials that will be described as "viscoelastic" or "damping", i.e. having elasticity properties with an intrinsic damping coefficient tg $\delta>0.4$, preferably tg $\delta$ between 0.8 and 1, measured on the basis of standard NF T 46 026 (at temperatures of −30° C. to +10° C. and at frequencies of 0.1 Hz to 120 Hz). This will damp the vibrations originating from the ski and afford the skier greater comfort. Elastomers such as chlorobutyls, nitrites or polyisoprenes will be materials suited for such uses.

Figure 7:
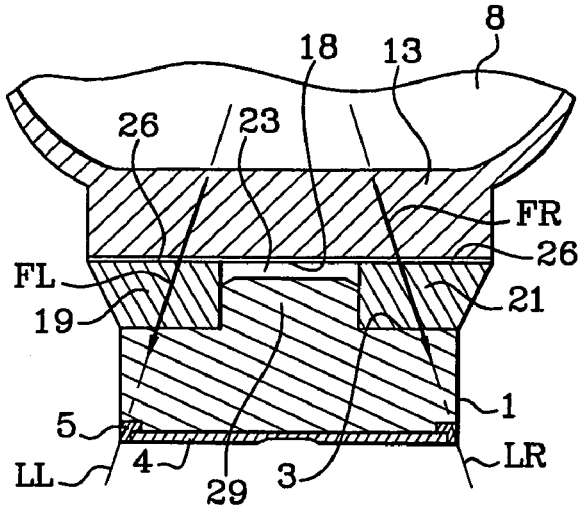
FIG. 7 shows a view in transverse section of the ski V of FIG. 1 with a support device being mounted on upper surface of the ski according to a further embodiment.

In another embodiment shown in FIG. 7, the space (23) is filled by a convex zone (29) of the ski (1). This convex zone projects between the two longitudinal parts (19 and 21) from the upper surface (3) of the protective and decorative upper layer.

This material or these materials or this projecting convex zone of the space (23) makes or make it possible to prevent, for example, snow and ice accumulating and compacting in the zone of the space (23), while preserving the mechanical separation of the two longitudinal parts (19 and 21). This prevents the forces applied by the skier from being transmitted to the entire section of the ski.

This material or these materials or this projecting convex zone also has or have an upper surface that is lower than the upper surface of the support device (14) and thus not flush with this upper surface of the support device (14). This makes it possible to prevent the sole (13) of the boot (8) from catching the material or materials or the projecting convex zone of the space (23).

The two longitudinal parts (19, 21) of the support device (14) also each comprise a region (24) that is raised relative to the upper surface (26) of the support device (14).

To allow optimum sliding of the boot (8) upon release, in the event of the user falling, the contact zone (17) or the raised region (24) of each of the two longitudinal parts (19, 21) of the support device (14) comprise a coating (27) in a material with a low coefficient of friction, for example in Teflon™, on which the lower face (18) of the sole (13) of the boot (8) will rest. The two longitudinal parts (19, 21) of this support device (14) could each be equipped with other known mechanisms (not shown), enhancing sliding with the sole (13) of the ski boot (8) for example those described in documents FR-2,755,868, U.S. Pat. No. 4,951,961, FR-2,741,816, US-2001,0011808 and EP-0 378,599.

Figure 8:
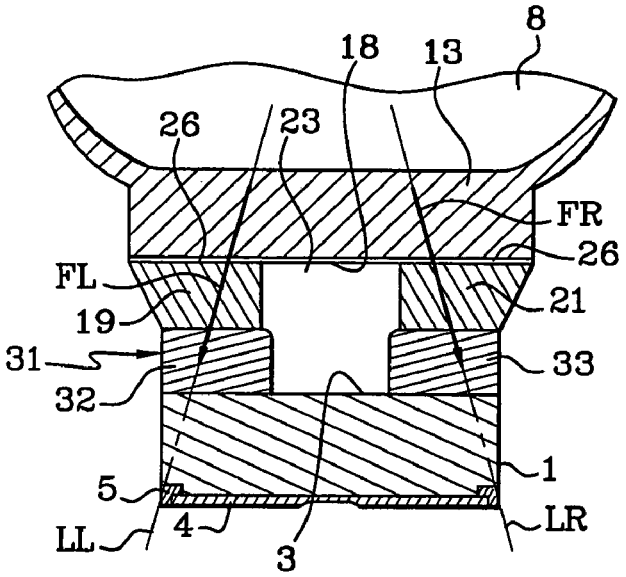
FIG. 8 shows a view in transverse section of the ski with a support device being mounted on a platform.

In a variant embodiment shown in FIG. 8, a platform (31) for raising the elements (6 and 7) of the binding is positioned in the region of the underfoot zone (2).

In a particularly advantageous case, and in order for the bearing forces exerted by the skier on one or the other of the two longitudinal parts (19 and 21) of the support device (14) to be transmitted even more directly to the edge (5), the raising platform is divided into two longitudinal parts (32 and 33) in the manner, for example, of the platform described in documents FR-01,09462 and FR-01,13779. The two longitudinal parts of the platform are each directly positioned on the upper surface of the board for gliding over snow. The two longitudinal parts of the raising platform therefore correspond to the two longitudinal parts of the support device (14).

Figure 9:
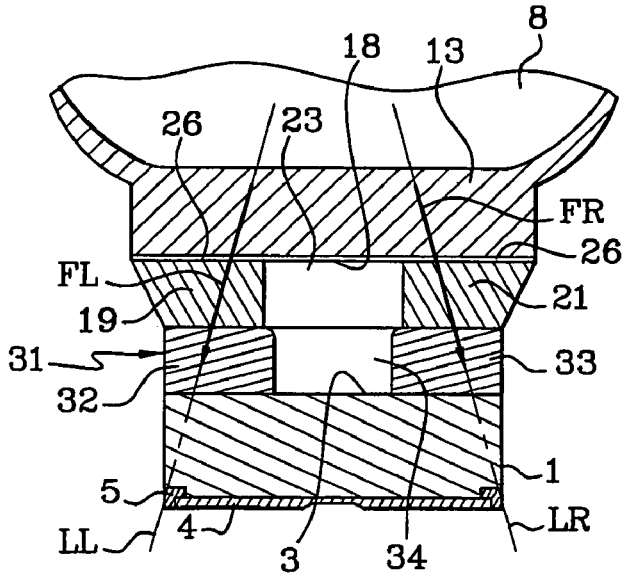
FIG. 9 shows a view in transverse section of the ski with a support device being mounted on a platform according to a further embodiment.

In a particular example shown in FIG. 9, the two longitudinal parts (32 and 33) of the raising platform (31) are connected together by at least one bridge (34) in the manner, for example, of the platform described in document FR-01,14312.

The present invention is not limited to the embodiments described and illustrated. A number of modifications may be made without therefore departing from the context defined by the scope of the set of claims.

The binding element and the platform may be mounted on all types of skis: skis of the "Dualtec®" type, "rectangular-section" skis, and "shell-structure" skis.

The invention claimed is:

1. A support device for a binding element securing a user's boot to a board for gliding over snow, comprising:

a first zone for mounting said support device on an upper surface of the board, and a second zone, part of which is in contact with a lower face of a sole of the user's boot, wherein said support device is divided into two longitudinal parts at least in a region of said second zone, said two longitudinal parts extending horizontally along a longitudinal extension direction of the upper surface of the board and vertically from at least said region of said second zone to said upper surface of the board, and said two longitudinal parts being mechanically separated from one another at least in said region of said second zone.

2. A binding element of a board for gliding over snow comprising a support device as claimed in claim 1.

3. A board for gliding over snow comprising a binding element as claimed in claim 2.

4. The binding element as claimed in claim 2, wherein said two longitudinal parts each include at least two upper surface planes that are different from one another one of which is in contact with the lower face of the sole of the user's boot in said second zone of said support device.

5. The binding element as claimed in claim 2, wherein portions of each of said two longitudinal parts in said second zone of said support device include a coating of a material having a low coefficient of friction on which said lower face of said sole of said boot rests.

6. The binding element as claimed in claim 2, wherein the binding element is mounted on the board for gliding over snow on a raising platform positioned on the upper surface of the board for gliding over snow.

7. The binding element as claimed in claim 6, wherein the raising platform is divided into two longitudinal parts that are each directly positioned on the upper surface of the board for gliding over snow, the two longitudinal parts of the raising platform corresponding to the two longitudinal parts of the support device.

8. The binding element as claimed in claim 7, wherein the two longitudinal parts of the raising platform are connected together by at least one bridge.

9. The binding element as claimed in claim 2, wherein said two longitudinal parts of said support device are spaced from one another.

10. The binding element as claimed in claim 9, further comprising one or more materials positioned between said two longitudinal parts, said one or more materials having low flexural stiffness and extending from an upper surface of said board toward an upper surface of said second zone of said support device to a plane below said upper surface of said second zone.

11. The binding element as claimed in claim 9, further comprising a convex zone of said board for gliding over snow projecting from an upper surface of a protective and decorative upper layer of said board, said convex zone being positioned between said two longitudinal parts and extending from said protective and decorative layer to a plane below an upper surface of said second zone of said support device.

* * * * *